US009757837B2

(12) United States Patent
Rizzo, Jr.

(10) Patent No.: US 9,757,837 B2
(45) Date of Patent: Sep. 12, 2017

(54) MACHINING TOOL INCLUDING A PIVOTING MACHINING ARM

(71) Applicant: UNITED TECHNOLOGIES CORPORATION, Farmington, CT (US)

(72) Inventor: John P. Rizzo, Jr., Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 30 days.

(21) Appl. No.: 14/793,498

(22) Filed: Jul. 7, 2015

(65) Prior Publication Data

US 2016/0023320 A1 Jan. 28, 2016

Related U.S. Application Data

(60) Provisional application No. 62/027,578, filed on Jul. 22, 2014.

(51) Int. Cl.
*B24B 21/00* (2006.01)
*B24B 23/06* (2006.01)
(Continued)

(52) U.S. Cl.
CPC ..... *B24B 21/006* (2013.01); *B24B 21/00* (2013.01); *B24B 21/20* (2013.01); *B24B 23/06* (2013.01); *B24B 41/002* (2013.01)

(58) Field of Classification Search
CPC ..... B24B 21/00; B24B 21/006; B24B 21/20; B24B 23/06
See application file for complete search history.

(56) References Cited

U.S. PATENT DOCUMENTS 2,401,670 A * 6/1946 Spetz ..... B24B 21/00 451/294
3,093,170 A * 6/1963 Thayer ..... B27B 17/0016 144/123

(Continued)

FOREIGN PATENT DOCUMENTS

JP 2006123059 A 5/2006

OTHER PUBLICATIONS

English Abstract for JP2006123059A; 2 pgs.
European Search Report for Application No. 15177839.6-1702/2977144; Dated: Feb. 3, 2016; 7 pgs.

*Primary Examiner* — Timothy V Eley
(74) *Attorney, Agent, or Firm* — Cantor Colburn LLP

(57) ABSTRACT

The present disclosure relates generally to a machining tool and method for using the machining tool. The machining tool includes a machining arm including a first arm section, a second arm section, a proximate end, a distal end, and a machining arm longitudinal axis, a belt disposed around the machining arm; and a first motor operably coupled to the machining arm, wherein at least a portion of the machining arm is configured to pivot such that an angle is formed between the distal end and the machining arm longitudinal axis. The method includes the steps of placing the pivotable machining arm in a first orientation, inserting the pivotable machining arm in the desired location, determining whether the belt is in a desired position relative to the raised surface, operating the motor to rotate the belt around the pivotable machining arm, and placing the belt in contact with the raised surface.

5 Claims, 4 Drawing Sheets

(51) Int. Cl.
*B24B 21/20* (2006.01)
*B24B 41/00* (2006.01)

(56) References Cited

U.S. PATENT DOCUMENTS

| | | | | | |
|---|---|---|---|---|---|
| 3,566,549 | A * | 3/1971 | Britton | B24B 23/06 | 451/355 |
| 3,823,513 | A * | 7/1974 | Welsch | B24B 23/06 | 451/355 |
| 4,509,296 | A * | 4/1985 | Rasmussen | B24B 21/00 | 269/74 |
| 5,628,678 | A * | 5/1997 | Tridico | B24B 21/02 | 451/296 |
| 6,503,128 | B1 | 1/2003 | Deware et al. | | |
| 6,648,737 | B2 * | 11/2003 | Deware | B24B 23/06 | 451/297 |
| 2014/0056713 | A1 | 2/2014 | Tomeo et al. | | |
| 2014/0141700 | A1 * | 5/2014 | Price | B24B 21/20 | 451/311 |

* cited by examiner

MACHINING TOOL INCLUDING A PIVOTING MACHINING ARM

CROSS REFERENCE TO RELATED APPLICATIONS

The present application is related to, and claims the priority benefit of, U.S. Provisional Patent Application Ser. No. 62/027,578 filed Jul. 22, 2014, the contents of which are hereby incorporated in their entirety into the present disclosure.

TECHNICAL FIELD OF THE DISCLOSED EMBODIMENTS

The present disclosure is generally related to machining and boring tools and, more specifically, a machining tool including a pivoting machining arm and a method of using the same.

BACKGROUND OF THE DISCLOSED EMBODIMENTS

Gas turbine engines, such as those used to power modern commercial aircraft or in industrial applications, include a compressor for pressurizing a supply of air, a combustor for burning a hydrocarbon fuel in the presence of the pressurized air, and a turbine for extracting energy from the resultant combustion gases. Generally, the compressor, combustor and turbine are disposed about a central engine axis with the compressor disposed axially upstream of the combustor and the turbine disposed axially downstream of the combustor.

Generally, the inner diameter of a rotor from the gas turbine engine requires machining to remove raised materials formed during manufacturing. Typically, this is done using a solid turning tool that moves through the center of the rotor and then positions its cutting edge between the bores, up to the surface needing to be machined. Certain rotor geometries do not allow a solid turning tool to reach deep enough to the inner diameter area requiring the removal of the raised materials.

Improvements in machining tools are therefore needed in the art.

SUMMARY OF THE DISCLOSED EMBODIMENTS

In one aspect, a machining tool including a pivoting machining arm is provided. The machining arm including a first arm section and a second arm section, a proximate end, a distal end, and a machining arm longitudinal axis. In one embodiment, at least a portion of the machining arm is configured to pivot such that an angle is formed between the distal end and the machining arm longitudinal axis. In one embodiment, the angle between the distal end and the machining arm longitudinal axis includes an angle between approximately 0° and approximately 180°. The machining tool 10 further includes a belt disposed around the machining arm. In one embodiment, the belt includes an abrasive coating suitable disposed thereon. The machining tool further includes a first motor operably coupled to the machining arm.

In one embodiment, the machining arm further includes a power pulley located adjacent to the first arm section, and at least one idler pulley located adjacent to the second arm section.

In one embodiment, the machining tool further includes a second motor (not shown) operably coupled to the second arm section. In one embodiment, a controller (not shown) is in communication with the second motor.

In one aspect a method for removing raised surfaces from a structure with a machining tool including a motor, a pivotable machining arm operably coupled to the motor, and a belt disposed around the pivotable machining arm is provided. The method includes the step of placing the pivotable machining arm in a first orientation. In one embodiment, placing the pivotable machining arm in a first orientation includes placing the pivotable machining arm such that the angle between the distal end and the machining arm longitudinal axis comprises an angle less than approximately 180°.

The method further includes the step of inserting the pivotable machining arm adjacent to a desired location. The method further includes the step of determining whether the belt is in a desired location relative to a raised surface. If it is determined that the belt is in a desired location relative to the raised surface; then the method proceeds to the step of operating the first motor to rotate the belt around the pivotable machining arm.

If it is determined that the belt is not in a desired location relative to the raised surface; then, the method proceeds to the step of placing the pivotable machining arm in a second orientation. In one embodiment, placing the pivotable machining arm in a second orientation includes placing the pivotable machining arm such that the angle between the distal end and the machining arm longitudinal axis includes an angle between approximately 0° and approximately 180°.

The method proceeds to the step of placing the belt in contact with the raised surface. The method further includes the step of removing the pivotable machining arm. In one embodiment, removing the pivotable machining arm includes placing the pivotable machining arm in a third orientation such that the angle between the distal end and the machining arm longitudinal axis includes an angle less than approximately 180°.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
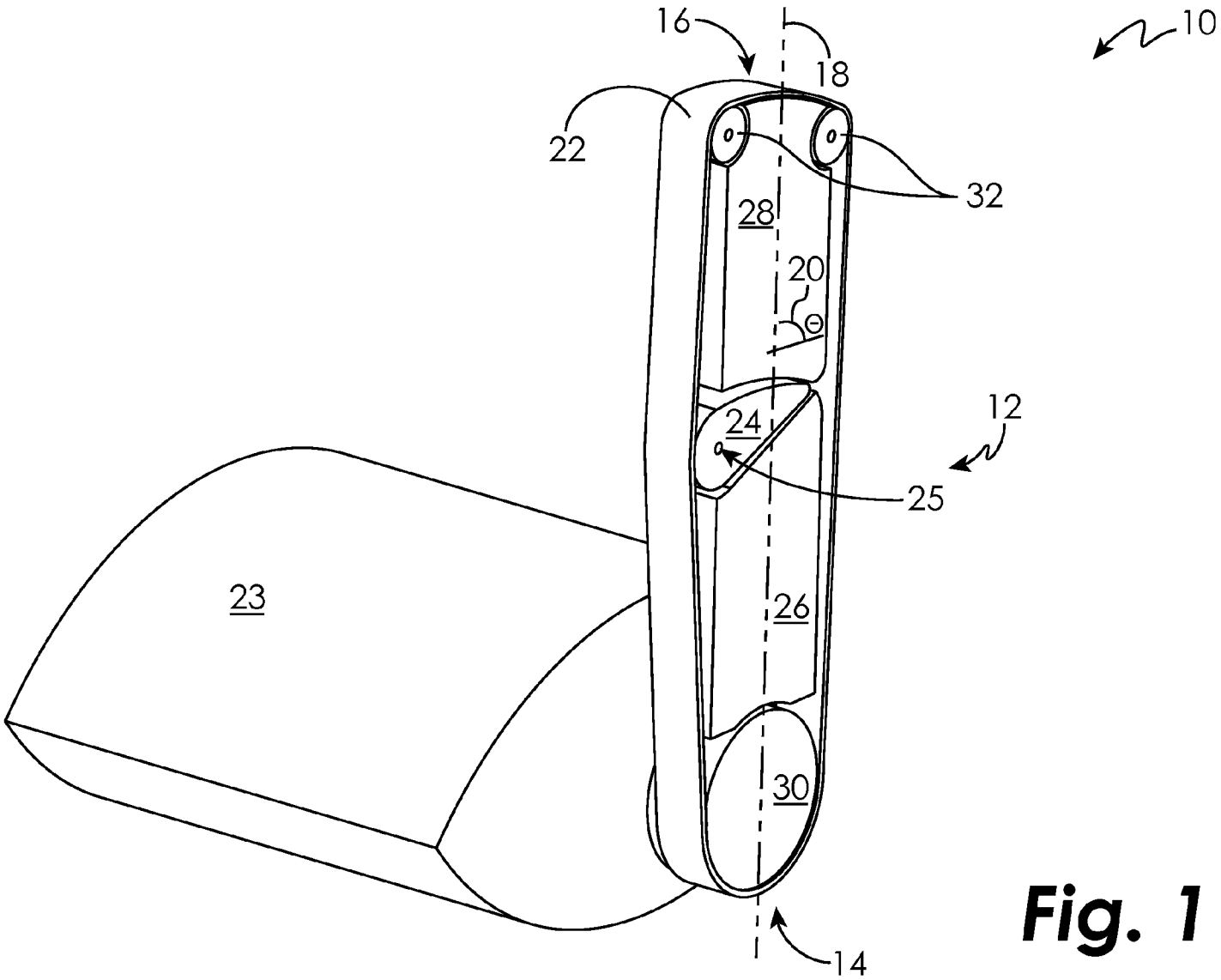
FIG. 1 is a schematic diagram of a machining tool of the present disclosure in a first configuration.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a machining tool 10 in a first configuration. The machining tool 10 includes a machining arm 12, including a proximate end 14, a distal end 16, and a machining arm longitudinal axis 18. At least a portion of the machining arm 12 is configured to pivot such that an angle 20 is formed between the distal end 16 and the machining arm longitudinal axis 18. In one embodiment, the angle 20 between the distal end 16 and the machining arm longitudinal axis 18 includes an angle between approximately 0° and approximately 180°. In the example shown, the machining arm 12 is in an extended configuration having an angle 20 of approximately 180° between the distal end 16 and the machining arm longitudinal axis 18. The machining tool 10 further includes a belt 22 disposed around the machining arm 12. In one embodiment, the belt 22 includes an abrasive coating suitable for boring through metal. The machining tool 10 further includes a first motor 23 operably coupled to the machining arm 12. The first motor 23 is configured to operate the machining arm 12 to rotate the belt 22.

Figure 2:
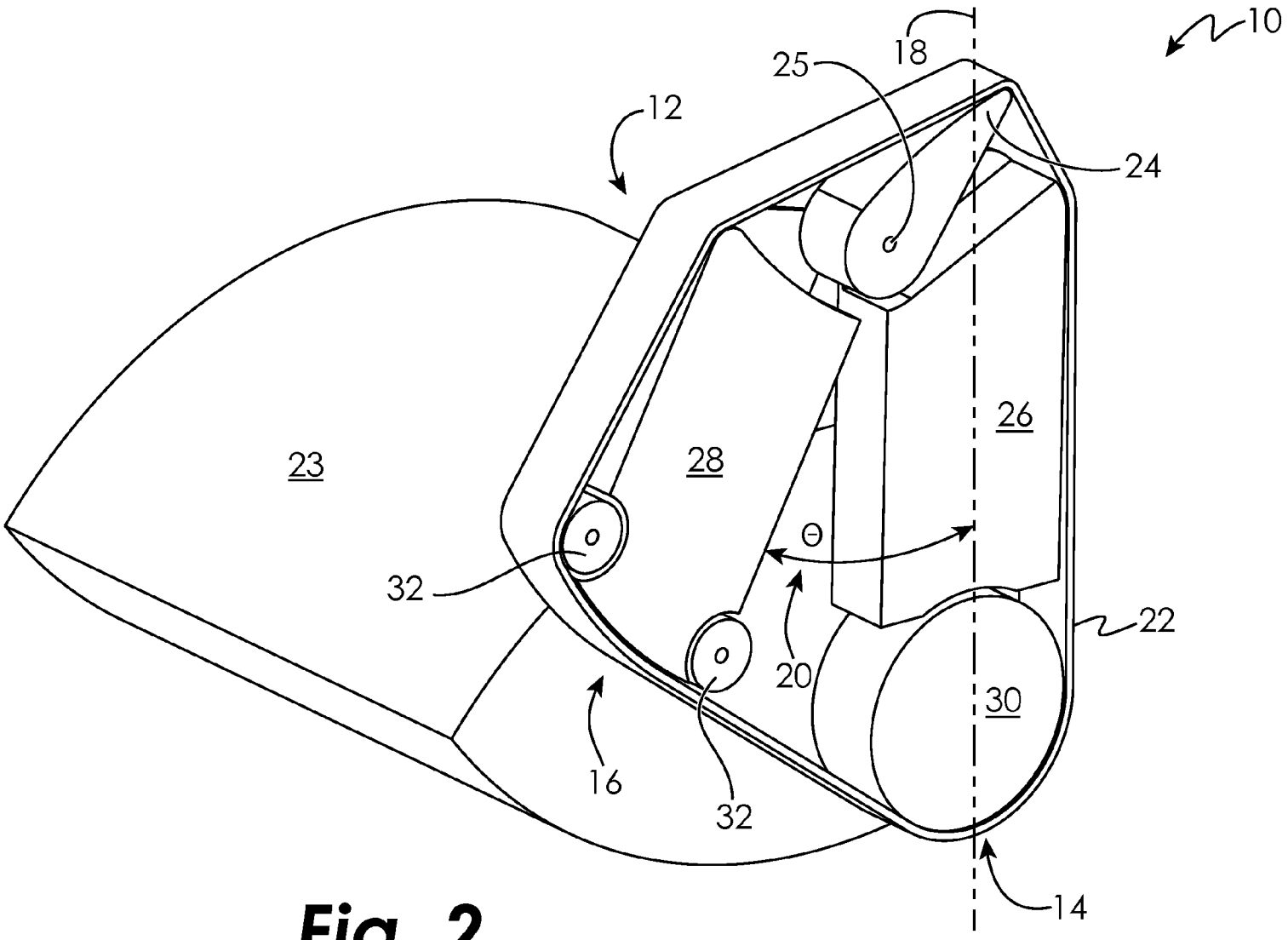
FIG. 2 is a schematic diagram of a machining tool of the present disclosure in a second configuration.

In one embodiment, the machining arm 12 includes a hinge component 24 located between a first arm section 26 and a second arm section 28. The second arm section 28 is configured to pivot around a pivot point 25 causing the second arm section 28 to pivot in a counterclockwise direction; thus, causing the distal end 16 to form the angle 20 with the machining arm longitudinal axis 18 (as shown in FIG. 2). It will be appreciated that the second arm section 28 may pivot in a clockwise direction. The machining arm 12 further includes a power pulley 30 located adjacent to the first arm section 26, and at least one idler pulley 32 located adjacent to the second arm section 28.

In one embodiment, the machining tool 10 further includes a second motor (not shown) operably coupled to the second arm section 28. The second motor is configured to pivot the second arm section 28 around the pivot point 25; thus, pivoting the distal end 16 of the pivoting machining arm 12. In one embodiment, a controller (not shown) is in communication with the second motor. The controller is configured to transmit a signal to the second motor, wherein the signal is indicative of the user's desired position of the second arm section 28 of the pivoting machining arm 12. For example, if the user prefers the distal end 16 of the pivoting machining arm 12 to be at a 30° angle from the machining arm longitudinal axis 18, the user may operate the controller to send a signal to the second motor to rotate until the distal end 16 of the machining arm 12 is at the desired position.

Figure 3:
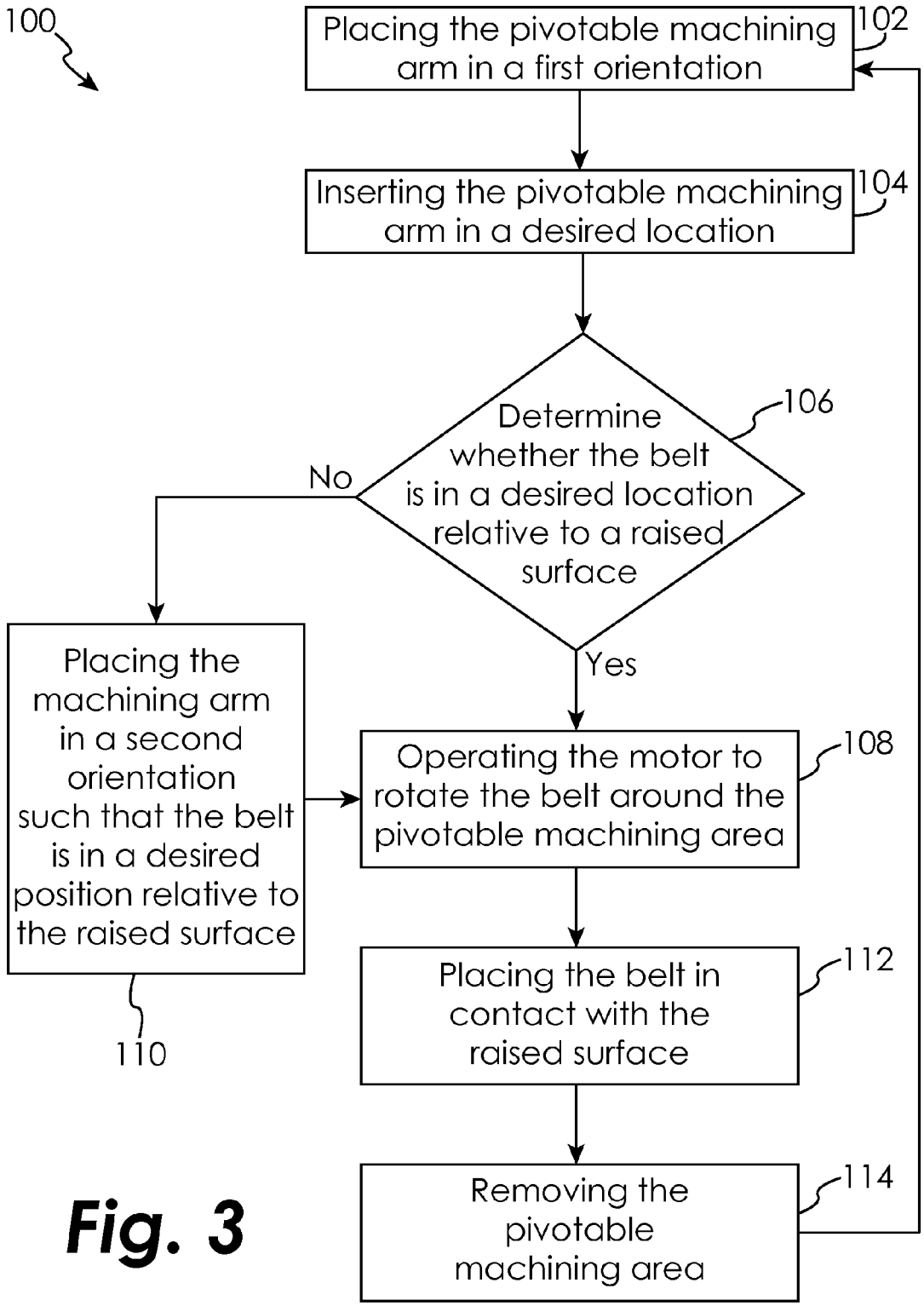
FIG. 3. is a schematic flow diagram of a method for operating the machining tool to remove raised surfaces from a structure.
Figure 4:
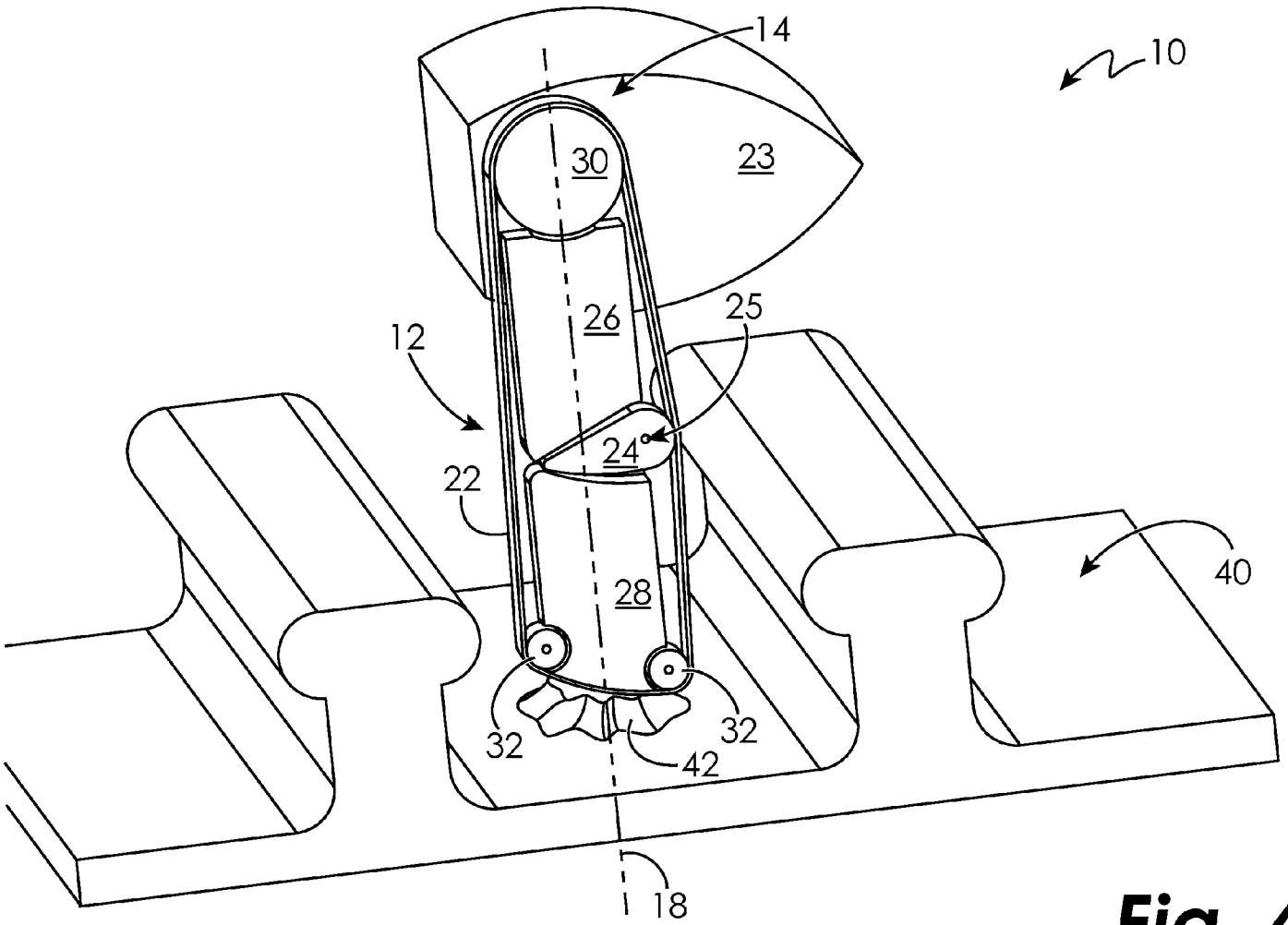
FIG. 4 is a schematic diagram of a machining tool of the present disclosure in use with a gas turbine engine rotor.

Referring to FIGS. 3-4, a method 100 for removing raised surfaces 42 from a structure 40 using the machining tool 10 described herein is provided. The method 100 includes the step 102 of placing the machining arm 12 in a first orientation. In one embodiment, placing the machining arm 12 in a first orientation includes placing the machining arm 12 such that the angle between the distal end 16 and the machining arm longitudinal axis 18 includes an angle 20 less than approximately 180°. For example, to prepare the machining tool 10 to enter a structure 40 to remove the raised surfaces 42, the second arm section 28 pivots around the pivot point 25 causing the distal end 16 to form the angle 20 with the machining arm longitudinal axis 18 that is less than approximately 180°. Placing the machining arm 12 in a collapsed orientation allows the machining arm 12 to easily enter the structure 40 to reach deep areas for tooling purposes.

The method 100 further includes the step 104 of inserting the machining arm 12 adjacent to a desired location. After placing the machining arm 12 in a first orientation the p machining arm 12 may now be placed in a desired location of the structure 40, for example deep areas of an inner diameter of a rotor assembly.

The method 100 further includes the step 106 of determining whether the belt 22 is in a desired location relative to a raised surface 42. If it is determined that the belt 22 is in a desired location relative to the raised surface 42; then the method 100 proceeds to step 108 of operating the first motor 23 to rotate the belt 22 around the machining arm 12.

If it is determined that the belt 22 is not in a desired location relative to the raised surface 42; then the method 100 proceeds to step 110 of placing the machining arm 12 in a second orientation such that the belt 22 is in a desired location relative to the raised surface 22. In one embodiment, placing the machining arm 12 in a second orientation includes placing the machining arm 12 such that the angle 20 between the distal end 16 and the machining arm longitudinal axis 18 includes an angle 20 between approximately 0°-180°. For example, if the second arm section 28 is not properly aligned to remove the raised surface 42, the second arm section 28 is pivoted around the pivot point 25 causing the distal end 16 to form the angle 20 with the machining arm longitudinal axis 18 until the second arm section 28 is placed in the desired position relative to the raised surface 42. In the example shown in FIG. 4, the angle 20 is approximately 180°.

Once the machining arm 12 is place in the desired position relative to the raised surface 42, the method 100 proceeds to step 112 of placing the belt 22 in contact with the raised surface 42. The belt 22 is placed in contact with the raised materials 42, and as the belt 22 circulates, the abrasive coating disposed thereon removes the raised materials 42 from the structure 40.

The method 100 further includes the step 114 of removing the machining arm 12. In one embodiment, removing the machining arm 12 includes placing the machining arm 12 in a third orientation such that the angle between the distal end 16 and the machining arm longitudinal axis 18 includes an angle 20 less than approximately 180°.

It will be appreciated that the machining arm 12 may reach the inner diameter of a rotor 40 to remove raised areas of material 42 from the inner diameter of the rotor 40; thus reducing the need for more expensive tooling machines. It will also be appreciated that the machining tool 10 may be used in numerous applications where typical machining tools cannot reach surfaces of a particular part.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A machining tool comprising:

a machining arm including a first arm section and a second arm section, a proximate end, a distal end, and a machining arm longitudinal axis;

a hinge component located between the first arm section and the second arm section;

a power pulley located adjacent to the first arm section;

at least one idler pulley located adjacent to the second arm section a belt disposed around the machining arm;

a first motor operably coupled to the machining arm;

wherein at least a portion of the machining arm is configured to pivot such that an angle is formed between the distal end and the machining arm longitudinal axis; and a second motor operably coupled to the hinge component.

2. The machining tool of claim 1, wherein the first motor is operably coupled to the power pulley.

3. The machining tool of claim 1, further comprising a controller in communication with the second motor.

4. The machining tool of claim 1, wherein the angle between the distal end and the machining arm longitudinal axis comprises an angle greater than 0° and approximately 180°.

5. The machining tool of claim 1, wherein the belt includes an abrasive coating.

* * * * *